US008631597B2

(12) United States Patent
Delorenzo

(10) Patent No.: US 8,631,597 B2
(45) Date of Patent: Jan. 21, 2014

(54) ROTATING ADAPTOR FOR SIGN

(71) Applicant: Dean Dominic Delorenzo, Denver, CO (US)

(72) Inventor: Dean Dominic Delorenzo, Denver, CO (US)

(73) Assignee: Dean D. Delorenzo, Denver, CO (US)

( * ) Notice: Subject to any disclaimer, the term of this patent is extended or adjusted under 35 U.S.C. 154(b) by 0 days.

(21) Appl. No.: 13/893,124

(22) Filed: May 13, 2013

(65) Prior Publication Data

US 2013/0298433 A1 Nov. 14, 2013

Related U.S. Application Data

(60) Provisional application No. 61/646,160, filed on May 11, 2012.

(51) Int. Cl.
*G09F 11/02* (2006.01)

(52) U.S. Cl.
USPC ..... 40/479; 40/606.14; 40/606.19; 40/607.03

(58) Field of Classification Search
USPC ..... 40/479, 440, 606.14, 606.15, 606.19, 40/607.03
See application file for complete search history.

(56) References Cited

U.S. PATENT DOCUMENTS

| | | | | | |
|---|---|---|---|---|---|
| 1,507,487 | A | * | 9/1924 | Klitz | 40/479 |
| 1,596,357 | A | * | 8/1926 | Jenkins | 40/479 |
| 3,469,335 | A | * | 9/1969 | Leigh | 40/605 |
| 3,716,288 | A | * | 2/1973 | Kannenberg | 359/552 |
| 4,524,533 | A | * | 6/1985 | Still, Jr. | 40/607.06 |
| 4,776,116 | A | * | 10/1988 | Shuman | 40/493 |
| 5,307,580 | A | * | 5/1994 | Farmer | 40/607.03 |
| 5,953,841 | A | * | 9/1999 | Sawyer | 40/479 |
| 2002/0121033 | A1 | * | 9/2002 | Hildyard et al. | 40/586 |
| 2006/0010738 | A1 | * | 1/2006 | Roark et al. | 40/479 |

* cited by examiner

*Primary Examiner* — Gary Hoge
(74) *Attorney, Agent, or Firm* — Dorsey & Whitney LLP

(57) ABSTRACT

A rotating adapter attaches a secondary sign to a primary sign. A first insert component includes an extended tine and a second insert component also has an extended tine. The second insert component may also include a shaft sleeve. A connection shaft is coupled to the first insert component, and is configured to insert within the shaft sleeve of the second insert component and defines an axis about which the second insert component may rotate. The extended tines of the first insert component fixedly couple with the primary sign and the extended tines of the second insert component fixedly couple with the secondary sign.

20 Claims, 10 Drawing Sheets

ROTATING ADAPTOR FOR SIGN

CROSS-REFERENCE TO RELATED APPLICATION

This application claims priority to U.S. provisional application No. 61/646,160 filed 11 May 2012, entitled "Rotating adaptor for a sign," which is hereby incorporated by reference in its entirety.

This application is related to U.S. non-provisional application Ser. No. 13/315,158 filed on 8 Dec. 2011 entitled "Rotating adaptor for a sign," which is hereby incorporated by reference in its entirety.

TECHNICAL FIELD

This disclosure generally relates to signs, and more specifically to a rotating adapter for a sign.

BACKGROUND

Signs are often used to attract potential customers to a specific location. For some businesses, a single large, permanent sign can be used to attract customers, such as the tall, lighted (and sometimes moving) signs located on the premises of supermarkets and restaurants. In other industries, however, smaller, less expensive, portable signs are needed, such as in the real estate industry. These more modest signs, however, may fail to captivate potential customers.

To remedy the lackluster nature of such signs, various types of attachments have been used to help draw attention to the signs. One example of an attachment is a corrugated board that can be used as a rider. The rider is typically attached to the main sign in a fixed configuration, such that it does not move. Such fixed riders may do little other than enlarge the total surface area of the sign visible to potential customers.

The information included in this Background section of the specification, including any references cited herein, and any description or discussion thereof, is included for technical reference purposes only and is not to be regarded subject matter by which the scope of the claims are bound.

SUMMARY

Embodiments described herein may relate to or take the form of an adapter for use with a stationary primary sign for attaching a secondary sign comprising a first insert component including at least one extended tine and a second insert component including at least one extended tine and a shaft sleeve. The rotating adapter may include a connection shaft coupled to the first insert component, configured to insert within the sleeve of the second insert component so as to define an axis about which the second insert component may rotate. Thereafter, the extended tine of the first insert component may fixedly couple to the primary sign and the extended tine of the second insert component may fixedly couple to the secondary sign.

In some embodiments the first insert component comprises at least three extended tines. In other embodiments, the first insert component may also include an aperture similar to the aperture within the second insert components. In such an embodiment, the connection shaft may be configured to insert within the aperture of the first insert components.

In further embodiments, the apertures present within the first or second insert components may extend entirely through the length of one of the extended tines of the respective insert components.

In certain embodiments the first insert component and second insert component fixedly couple to the primary sign and second sign, respectively, by friction fit.

In certain embodiments, the primary sign may be stationary.

In further embodiments, the extended tines of the first or second insert components are tapered.

In further embodiments, the connection shaft comprises a metal rod, the insert components are made of weather-resistant plastic, and the primary and secondary signs are comprised of a corrugated material.

Further embodiments described herein may additionally take the form of a rotating adapter for attaching a secondary sign to a primary sign wherein a first insert component comprises a base portion, at least three extended tines, and a shaft sleeve extending through the base portion and through one of the at least three extended tines. The rotating adapter may also include a second insert component comprising a base portion, at least three extended tines, and a shaft sleeve extending through the base portion and through one of the at least three extended tines. In addition, the rotating adapter may include a connection shaft configured to insert into the shaft sleeves and rotatably couple the first and second insert components. The connection shaft may include a shaft portion and at least two stopper portions configured to prevent the first insert component and the second insert component from separating.

In a similar embodiment, the connection shaft is comprised of metal and the first and second insert components are comprised of weather-resistant plastic, and signs to which the first and second insert components may fixedly couple may be comprised of a corrugated material.

In certain embodiments, the at least two stopper portions may comprise crimpings of the material selected for the connection shaft.

In certain embodiments, the base portion of either the first insert component or the second insert component comprises a surface area suitable to display identifying markings.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

This disclosure details various embodiments of a rotating adapter for a sign that may be used to pivotally couple a rider sign to a fixed main sign. The rotating adapter may comprise three independent parts, including two insert components and a connection shaft. Either of the two insert components may be inserted into the corrugations of a main sign or into the corrugations of rider sign. In certain embodiments, the insert components may comprise two or more extended tines which may be inserted into parallel corrugations of a sign. The two insert components may be made of the same or different materials. In certain embodiments, the two insert components may be identical and interchangeable. In other embodiments, the two insert components may have different shapes.

In certain embodiments multiple extended tines of a single insert component may be symmetrical about a shaft sleeve within the insert component. In some embodiments the lengths of multiple extended tines of a single insert component may differ. For example, and without limitation, a shaft sleeve may be formed within a central extended tine of an insert component which is longer than peripheral extended tines of the same insert component. In another embodiment, a shaft sleeve may be present within a peripheral extended tine of an insert component.

The connection shaft may comprise a rod which pivotally couples two independent insert components about the connection shaft's longitudinal axis. In certain embodiments, the connection shaft may be inserted through a shaft sleeve present within an extended tine of each insert component. In other embodiments, the connection shaft may comprise a rod permanently affixed to a first insert component and inserted through a shaft sleeve of a second insert component such that the second insert component pivots about the longitudinal axis of the connection shaft. In further embodiments, the connection shaft may be crimped at end points to prevent the insert components from unwanted separation.

Reference will now be made to representative embodiments illustrated in the accompanying figures. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

Figure 1:
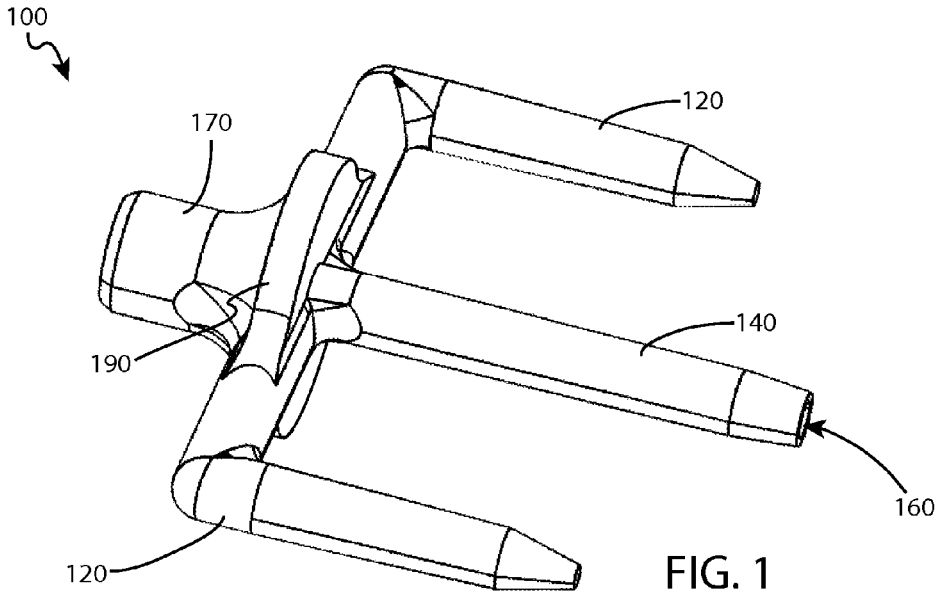
FIG. 1 is an isometric view of one insert component of a rotating adapter for a sign.
Figure 2:
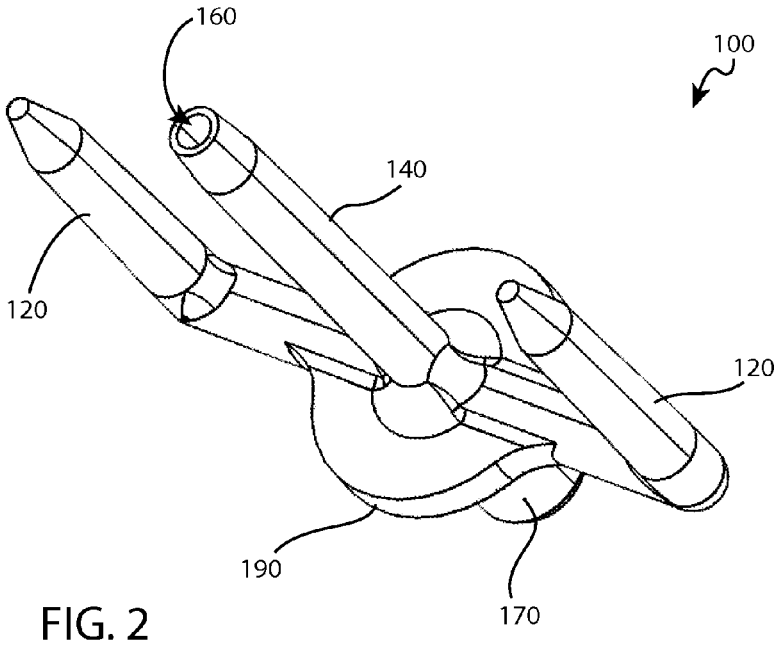
FIG. 2 is a rotated isometric view of the insert component as shown in FIG. 1.

FIG. 1 is an isometric view of one insert component 100 of a rotating adapter for a sign. The insert component 100 as shown has three substantially parallel extended tines, two peripheral extended tines 120 and a central extended tine 140. A shaft sleeve 160 is formed through the central extended tine 140, which extends through the length of the insert component 100. In certain embodiments, such as the embodiment shown in FIG. 1, the extended tines 120 and 140 may be tapered at their distal ends. Tapering may provide for easier insertion of the extended tines 120, 140 within parallel corrugations of a sign. The extended tines 120, 140 can meet at a central base portion 190. The central base portion 190 may be of any suitable geometry. In the embodiment of FIG. 1, the extended tines 120,140 and the base portion 190 are formed as a trident. In the embodiment of FIG. 1 the central extended tine 140 is longer than the peripheral extended tines 120, but this configuration is not required (e.g. all tines may be of equal length, different lengths, or the central tine may be shorter than peripheral tines). In some embodiments, the central base portion 190 may be enlarged so as to provide a surface on which a manufacturer may place identifying information. In other embodiments, the base portion 190 may also comprise additional support structures which either gain support from a fixed main sign or provide support to a rotatable rider sign. For example, the base portion 190 may have laterally extending flange areas that engage the exterior surface (e.g. the top edge or bottom edge or both), of the sign.

A journal portion 170 may extend below the base portion 190. The journal portion 170 may assist rotation of the insert component 100 about the longitudinal axis through the center of the shaft sleeve 160. The journal portion 170 may, in certain embodiments, have a larger diameter than the extended tines.

The insert component 100 may be constructed of any suitable material. In certain embodiments where a sign may be placed outside for an extended period of time, the insert component 100 may be constructed of a weather-durable material such as stainless steel or durable plastic. In certain embodiments, the insert component may be constructed of a combination of materials.

Figure 3:
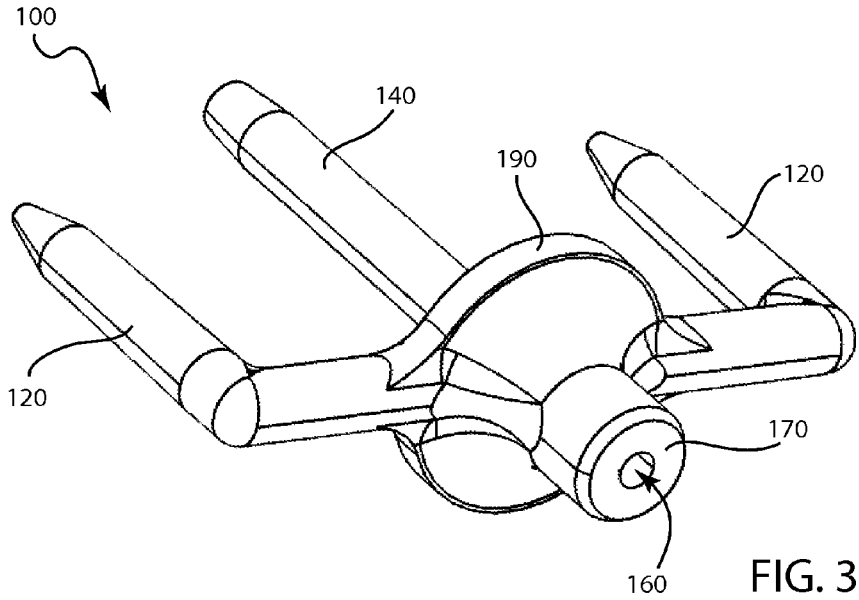
FIG. 3 is a top isometric rear view of the insert component as shown in FIG. 1.
Figure 4:
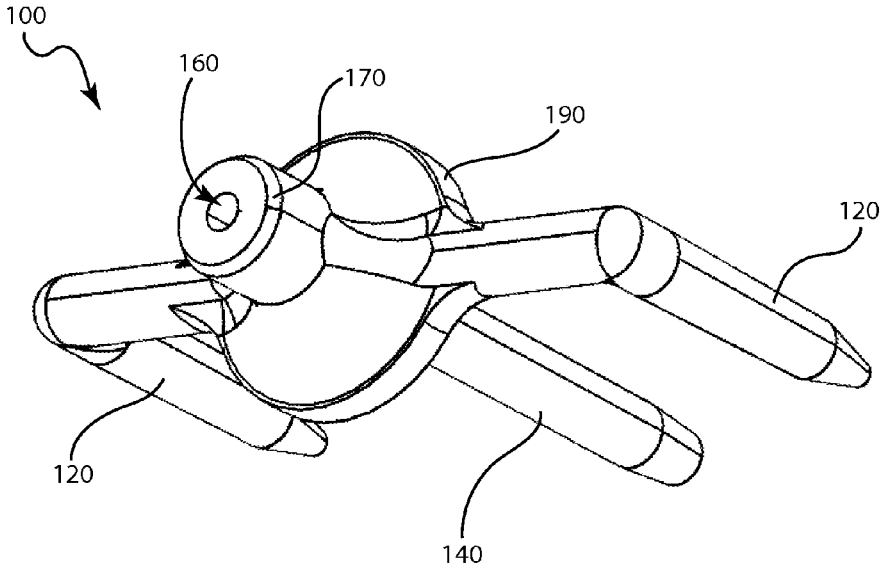
FIG. 4 is a bottom isometric rear view of the insert component as shown in FIG. 1.
Figure 5:
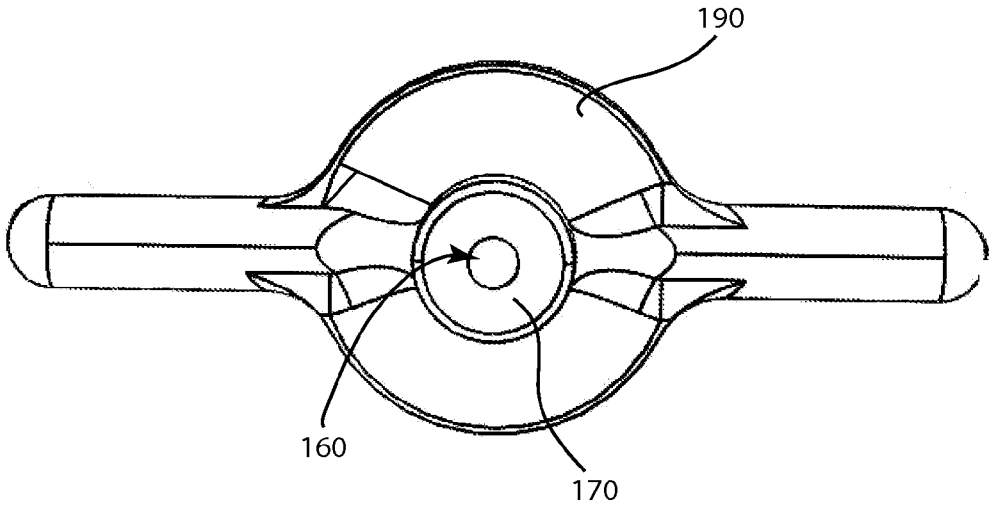
FIG. 5 is a bottom plan view of the insert component as shown in FIG. 1.
Figure 6:
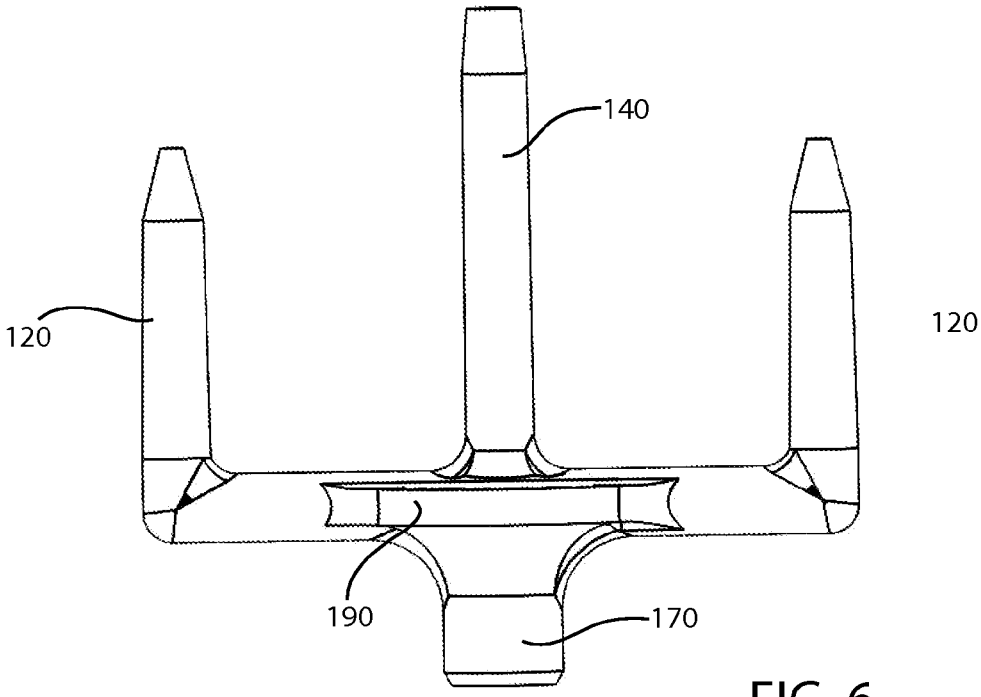
FIG. 6 is a front elevation view of the insert component as shown in FIG. 1.
Figure 7:
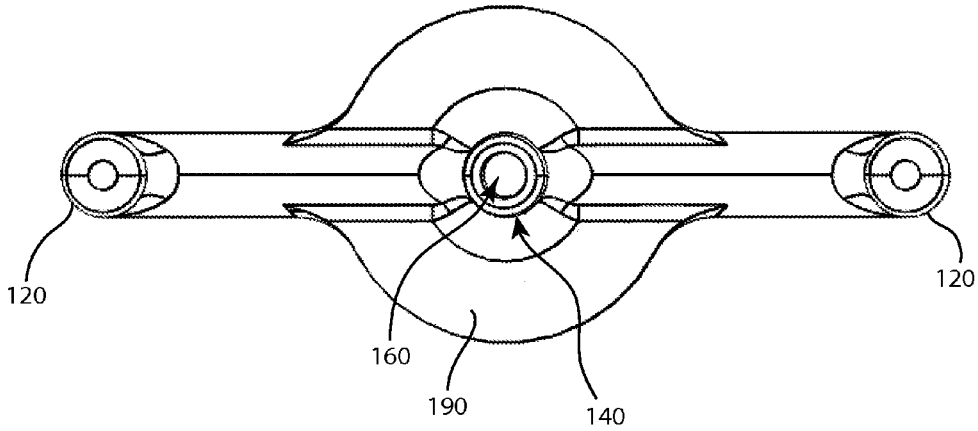
FIG. 7 is a top plan view of the insert component as shown in FIG. 1.
Figure 8:
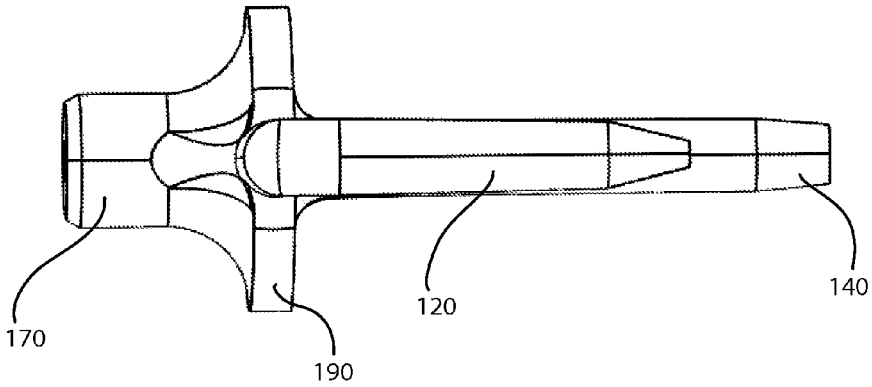
FIG. 8 is a side elevation view of the insert component as shown in FIG. 1.

FIGS. 2-8 show different views of the insert component 100. As shown in FIGS. 3-4, the shaft sleeve 160 extends through the central extended tine 140, through the central base portion 190, and through the journal portion 170. Although as illustrated the shaft sleeve 160 is present within the central extended tine, it may be appreciated that the shaft sleeve 160 alternatively may be present within either of the extended tines 120. In these embodiments, the base portion 190 will no longer be centralized, nor will the journal portion 170. In such an embodiment, on may appreciate that the axis of rotation will also shift from the center of the insert component 100.

Figure 9A:
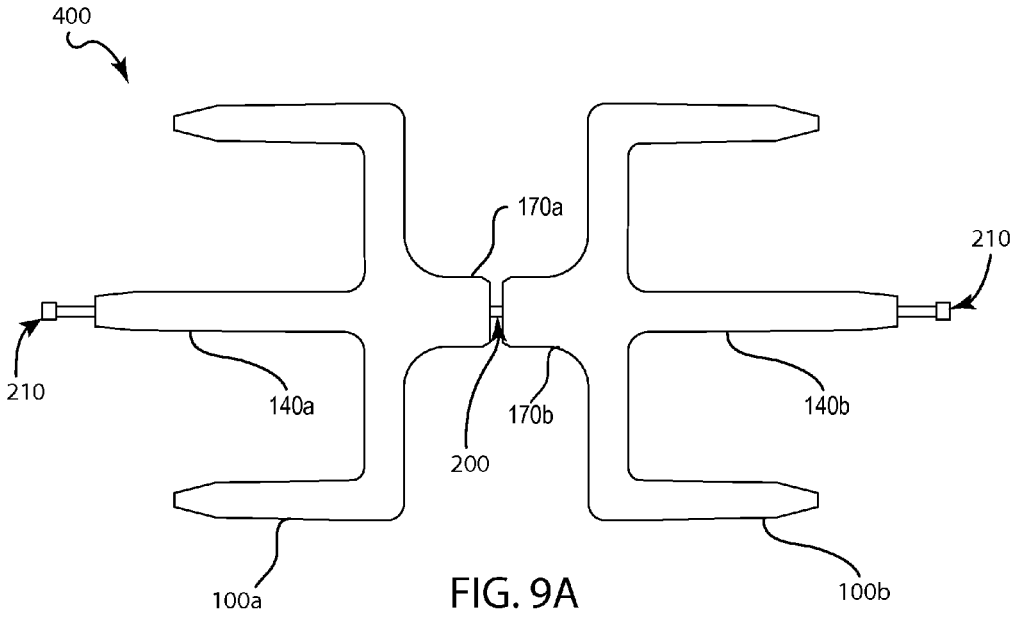
FIG. 9A is schematic front elevation view of a rotating adapter for a sign.
Figure 9B:
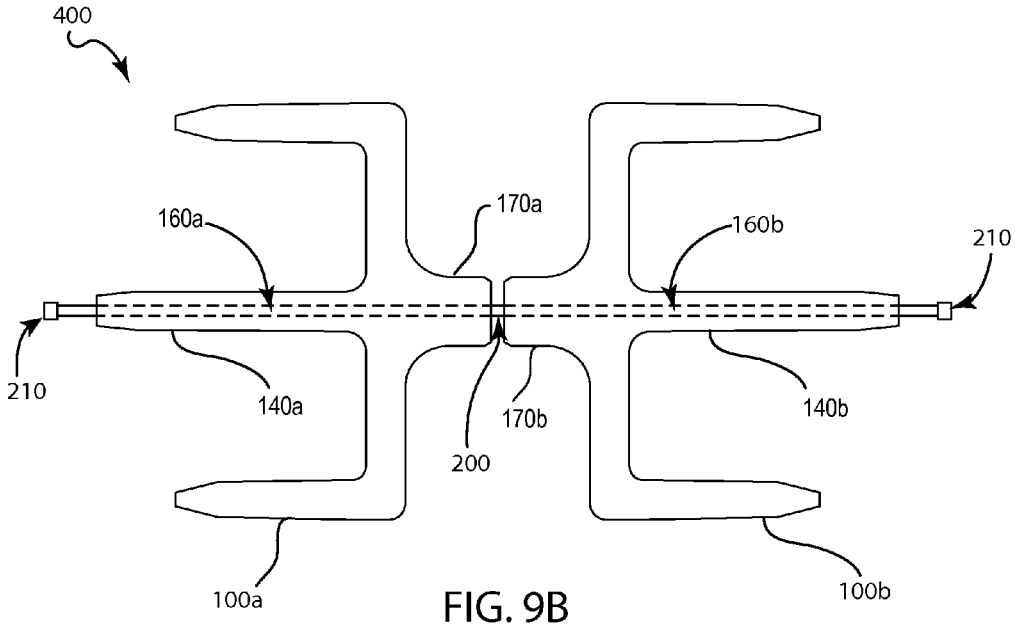
FIG. 9B is schematic front elevation view of a rotating adapter for a sign as shown in FIG. 9A, depicting the shaft within the insert components.
Figure 9C:
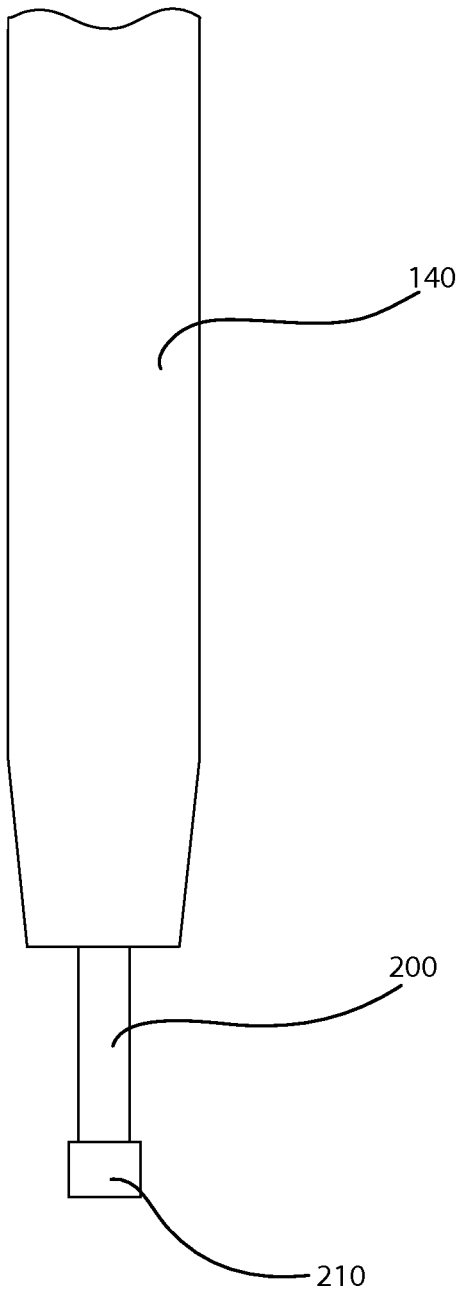
FIG. 9C is an enlarged schematic view detailing a crimped connection portion of the shaft of the rotating adapter for a sign as shown in FIG. 9A.

FIG. 9A shows rotating adapter 400 assembled with a connection shaft 200 and two independent insert components 100*a* and 100*b*. FIG. 9B shows the rotating adapter 400 as shown in FIG. 9A, with shaft sleeves 160*a*, 160*b* indicated. The insert components 100*a* and 100*b* are pivotally coupled along a central longitudinal axis by the connection shaft 200. The connection shaft 200 is inserted through the shaft sleeve 160*a*, 160*b* of each insert component 100*a*,100*b* shown in FIG. 9A within the central extended tines 140*a*, 140*b*. As shown, the connection shaft 200 extends beyond the combined longitudinal length of the central extended tines 140*a*, 140*b* and journal portions 170*a*, 170*b* of the rotating adapter 400. At each end, the connection shaft 200 has been crimped into stopper 210. The crimping may be such that the insert components 100*a* and 100*b* do not slide apart during use of the rotating adapter 400. Accordingly, the stopper 210 must be of sufficient width such that the maximum dimension of the crimp is larger than the diameter of each shaft sleeve 106*a*, 160*b* through each of insert component 100*a* and 100*b*. FIG. 9C is a detail view of one end of the connection shaft 200, extending through and beyond central extended tine 140 which has been crimped into stopper 210.

One may appreciate that the stopper 210 need not necessarily be a crimping. In certain other embodiments, in place of stopper 210 an end cap may be affixed to the connection shaft 200 which is larger than the diameter of the shaft sleeves. In another embodiment, the ends of the connection shaft 200 may be threaded and a threaded nut may be screwed on to function as stopper 210. In further embodiments, the connection shaft 200 may be bifurcated at the endpoints. In further embodiments, a crimping may not be present at all.

One may further appreciate that the connection shaft 200 need not extend through a shaft sleeve 160*a*, 160*b* of an extended tine 120, 140 of an insert component 100. For example, in an alternative embodiment the connection shaft may extend through an aperture in the journal portion 170 only.

Figure 10:
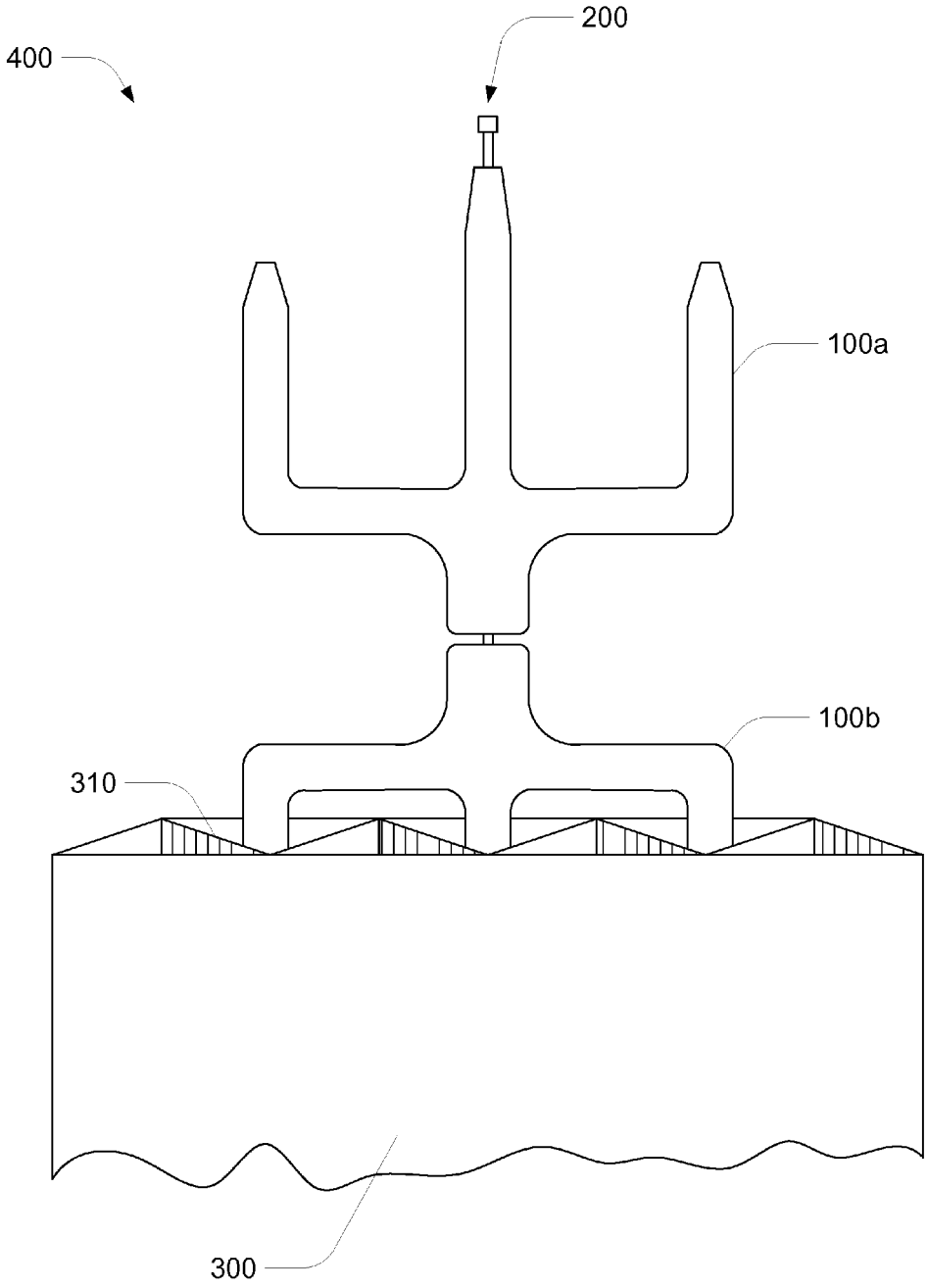
FIG. 10 is schematic front view of a rotating adapter for a sign inserted into the corrugations of a main sign.

FIG. 10 is a rotating adapter 400 assembled with a connection shaft 200 and two independent insert components 100*a* and 100*b*, with the three extended tines of insert component 100*b* inserted into parallel corrugations 310 of a main sign 300. In this particular embodiment, the rotating adapter 400 has not been entirely inserted into main sign 300, but instead is shown only partially inserted for illustrative purposes. FIG. 10 further shows the connection shaft 100*a* ready to receive a rider sign.

Figure 11:
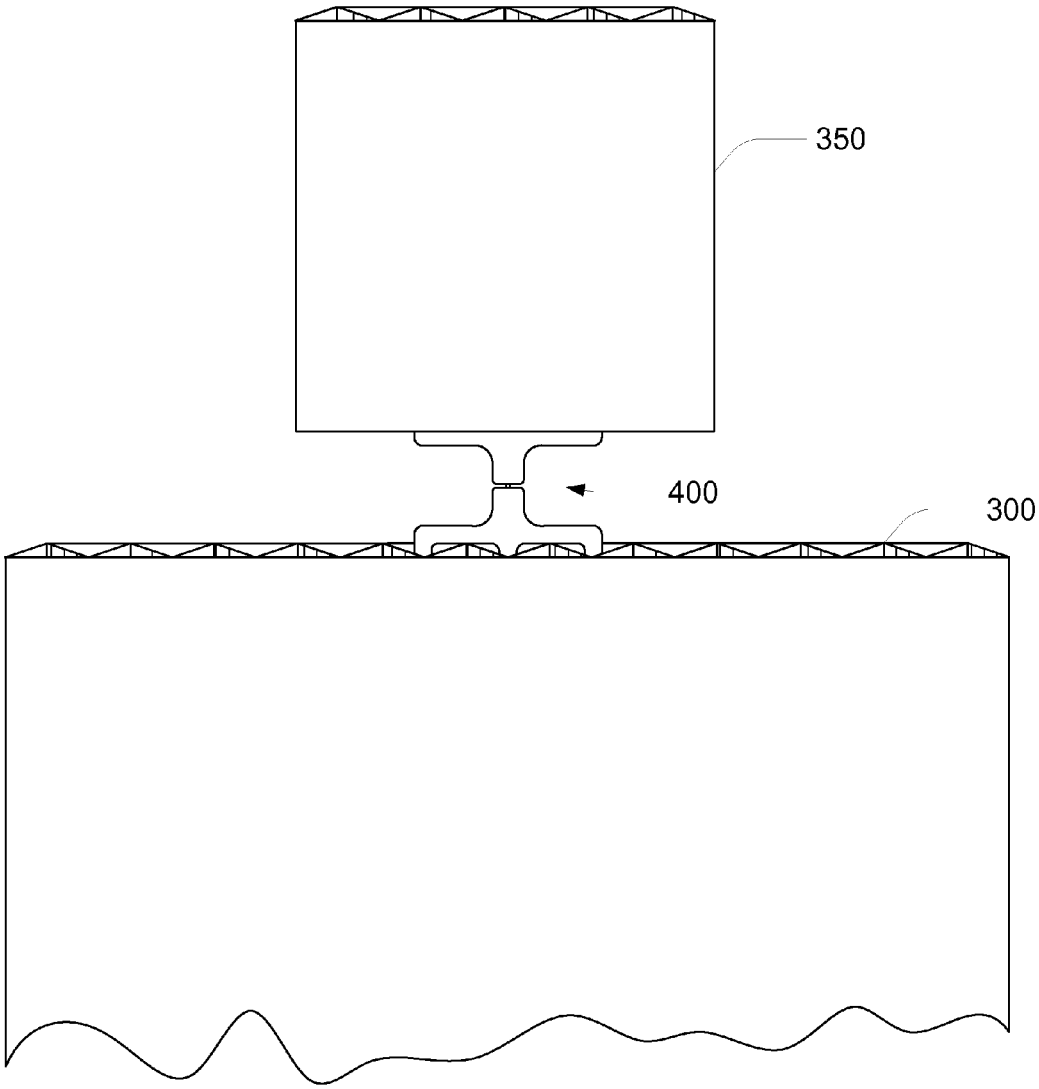
FIG. 11 is a schematic front isometric view of a rotating adapter for a sign pivotally coupling a main sign to a rider sign.
Figure 12:
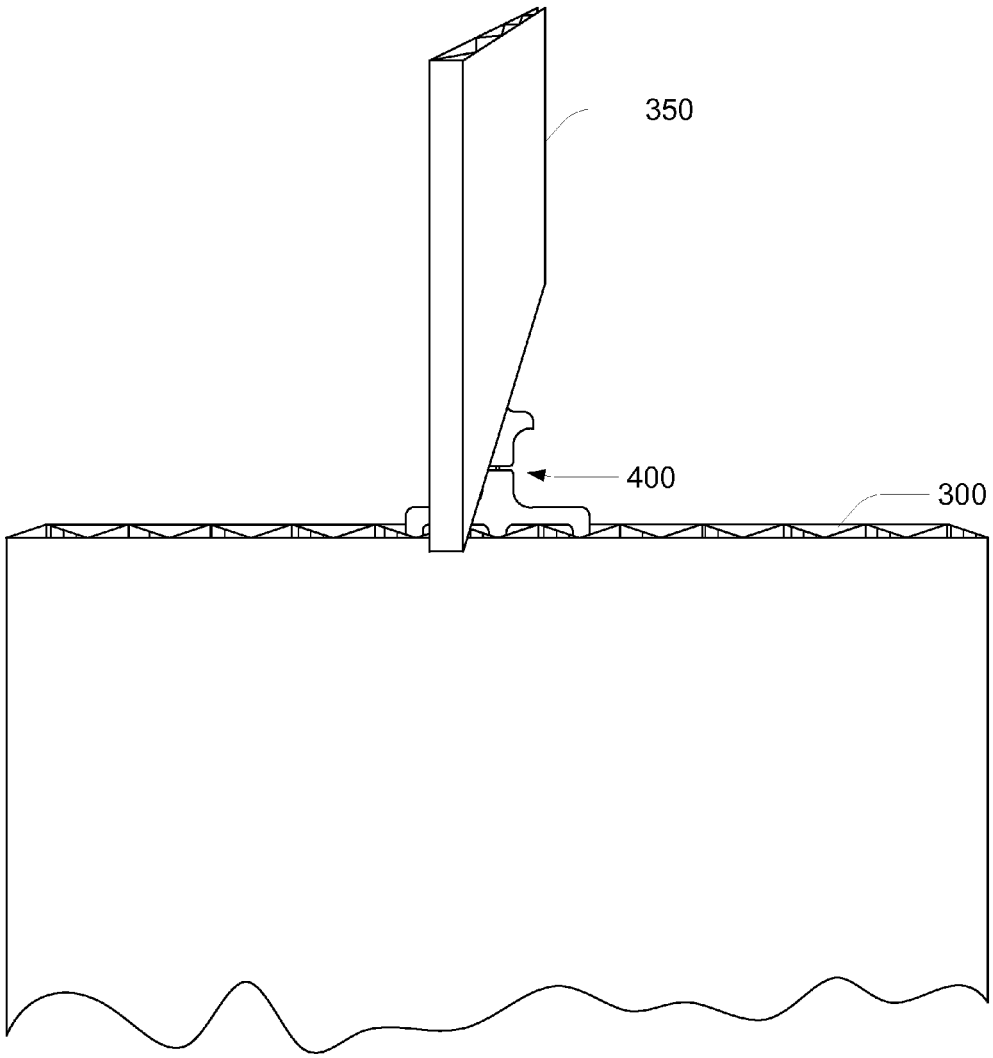
FIG. 12 is a schematic presentation of a main sign and rider sign as shown in FIG. 11 with the rider sign rotated about the axis of the rotating adapter.

FIG. 11 is the embodiment as depicted in FIG. 10, with the rotating adapter 400 fully inserted into the main sign 300 and fully inserted into the rider sign 350. FIG. 12 is the same embodiment as in FIGS. 10-11 with the rider sign 350 rotating about the longitudinal axis of the connection shaft (not shown). One may appreciate that although the rider sign 350 is shown as a square of substantially smaller surface are compared to the main sign 300, neither the shape nor the size of the rider sign 350 impact the function of the rotating adapter 400. A rider sign 350 may be of any suitable shape so long as the rotating adapter 400 may be inserted within the corrugations of the rider sign 350.

Figure 13:
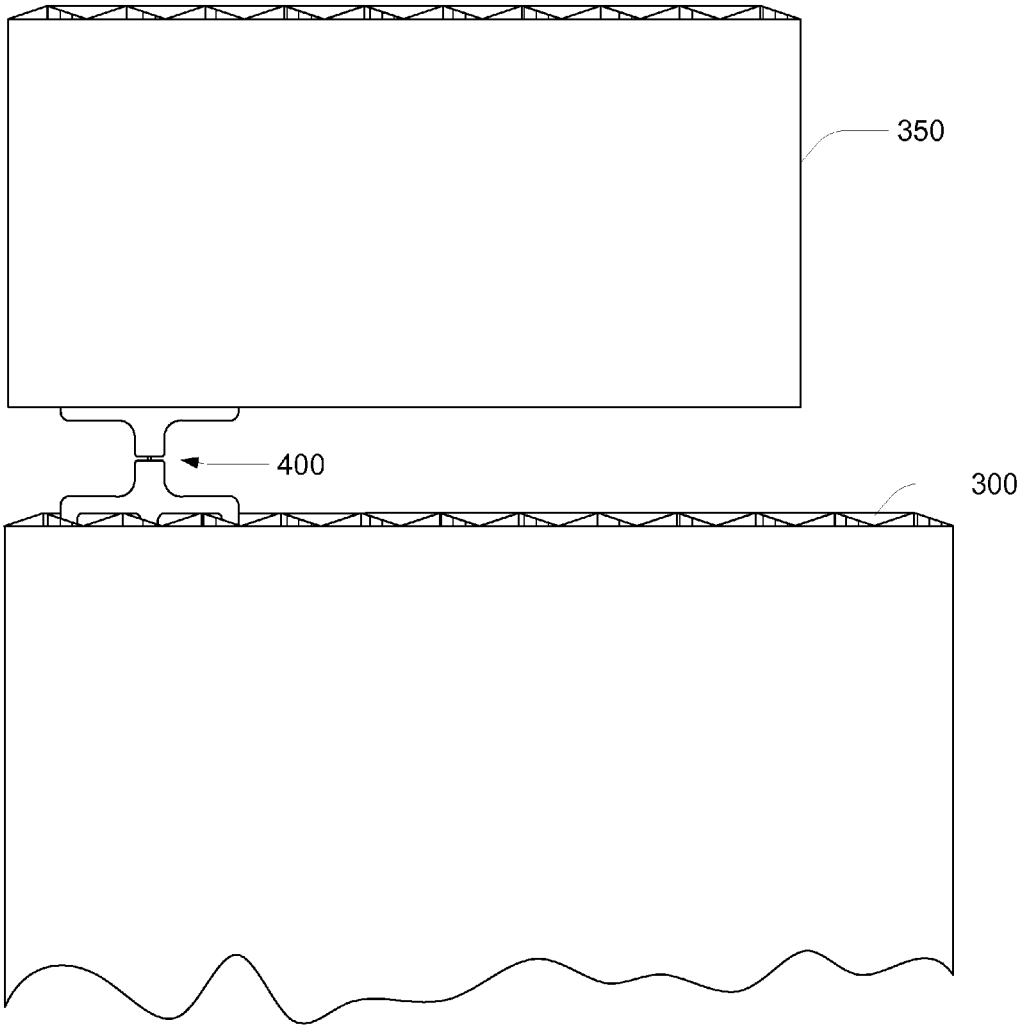
FIG. 13 is a schematic isometric front view of a rotating adapter for a sign rotatably coupling a main sign to a rider sign about an off-center axis.

FIG. 13 is an embodiment similar to that shown in FIG. 10 with the rotating adapter 400 placed off a central axis of either the main sign 300 or the rider sign 400. In the illustrated embodiment, the rider sign 350 is free to rotate along an axis positioned along one side, instead of rotating along an axis through the center. One may appreciate that the rotating adapter may be placed in any location along either the main sign 300 or the rider sign 350.

In certain other embodiments, the connection shaft and insert components may be placed or modified so that the rotation axis is along any axis. For instance, in certain embodiments, the connection shaft may be bent at ninety degrees such that a rider sign may be pivotally coupled to a main sign along the horizontal axis, instead of the along a vertical axis as illustrated in FIGS. 11-13 and described in the embodiments above. In such a case, a rider sign may be similar to a pendulum. In alternate embodiments the connection shaft may be bent along any arbitrary angle.

In certain embodiments, the connection shaft may be affixed to a first insert component, allowing the second insert component to freely pivot.

One may further appreciate that the number of extended tines may vary, and that two insert components connected by a single connection shaft need not necessarily have the same number of extended tines. Further, one may appreciate that the connection shafts need not necessarily have identical shapes, or identical apertures through which the connection shaft may be inserted. For example, a rider sign insert component may only have two extended tines, whereas the main sign insert component may have four.

In further embodiments, the journal portion may be made or coated with a suitable material, or alternately, finished in a suitable process in a way so as to provide the least amount of friction opposing pivot of the rider sign. In certain embodiments, the surface of the journal portion may be smoothed in a manufacturing process to reduce friction with respect to the connection shaft. In other embodiments, the journal portion my house a bearing so as to reduce friction with respect to the connector component In another embodiment the journal portion may be coated with a low-friction coating.

In certain embodiments the journal portion may include a rotation stop portion so as to define a maximum range of rotation beyond which the rider sign is not permitted.

In further embodiments the center base portion may include rotation-correcting features so that the rider sign returns to a particular angle when the rotating adapter no longer experiences force (i.e., wind stops). Such a rotation-correcting feature may include complementary permanent magnets or, in other embodiments, a spring to restore the rider sign to a particular orientation. One may appreciate that such features may also be included within the journal portion.

In further embodiments, a secondary rider sign may be attached to a primary rider sign such that both signs may independently rotate. In further embodiments, a secondary main sign may be attached along the same axis as a primary main sign. In other words, the rider sign may be positioned between, and rotated between, two larger primary signs.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A rotating adapter for a sign comprising a first insert component having a first tine;

a second insert component having a second tine and an aperture defined along an axis parallel to the second tine; and a connection shaft coupled to the first insert component and configured to insert within the aperture of the second insert component, wherein the connection shaft defines an axis about which the second insert component may rotate; and wherein the first tine couples to a primary sign by friction fit with the structure of the primary sign along an edge of the primary sign; and the second tine couples to a secondary sign by friction fit with the structure of the secondary sign along an edge of the secondary sign.

2. The rotating adapter of claim 1, wherein the first insert component comprises at least three tines.

3. The rotating adapter of claim 1, wherein the first insert component further comprises an aperture defined along an axis parallel to the first tine.

4. The rotating adapter of claim 3, wherein the connection shaft is configured to insert within the aperture of the first insert component, defining an axis about which the first insert component may rotate.

5. The rotating adapter of claim 3, wherein the aperture of the first insert component extends through the first time.

6. The rotating adapter of claim 1, wherein the aperture of the second insert component extends through the second time.

7. The rotating adapter of claim 1, wherein the primary sign is made of a corrugated material.

8. The rotating adapter of claim 1, wherein the secondary sign is made of a corrugated material.

9. The rotating adapter of claim 1, wherein the primary sign maintains a fixed position.

10. The rotating adapter of claim 1, wherein the distal end of the first tine is tapered and the distal end of the second tine is tapered.

11. The rotating adapter of claim 1, wherein the connection shaft comprises a metal rod.

12. The rotating adapter of claim 1, wherein the first and second insert components are formed by injection molding of a weather-resistant plastic.

13. The rotating adapter of claim 1, wherein the primary and secondary signs are comprised of a weather-resistant material.

14. A rotating adapter for attaching a secondary sign to a primary sign comprising a first insert component comprising a base portion;

at least three tines; and an aperture that extends through the base portion through one of the at least three tines along an axis parallel to the at least three tines;

a second insert component comprising a base portion;

at least three extended tines;

an aperture that extends through the base portion through one of the at least three tines along an axis parallel to the at least three tines; and a connection shaft comprising a shaft portion to extend through the apertures of and rotatably couple the first and second insert components and a stopper portion on each end of the connection shaft configured to prevent the first insert component and the second insert component from separating from the connection shaft.

15. The rotating adapter of claim 14, wherein the connection shaft is a metal rod.

16. The rotating adapter of claim 14, wherein the at least two stopper portions comprise crimpings of the material of the connection shaft.

17. The rotating adapter of claim 14, wherein the first and second insert components are formed by injection molding of weather-resistant plastic.

18. The rotating adapter of claim 14, wherein the base portion of at least one of the first insert component and the second insert component comprises surface area suitable to display identifying markings.

19. The rotating adapter of claim 14, wherein the first insert component is configured to fixedly couple to a primary sign, and the second insert component is configured to fixedly couple to a secondary sign by frictionally engaging corrugation channels in edges of the material forming the primary and secondary signs.

20. The rotating adapter of claim 19, wherein the primary and secondary signs are comprised of weather-resistant material.

* * * * *